United States Patent [19]

Thompson

[11] 4,194,739

[45] Mar. 25, 1980

[54] ADJUSTABLE GOLF PUTTER

[76] Inventor: Woodrow F. Thompson, 440 Pine Villa Dr., Atlantis, Fla. 33462

[21] Appl. No.: 932,081

[22] Filed: Aug. 8, 1978

Related U.S. Application Data

[63] Continuation-in-part of Ser. No. 852,644, Nov. 18, 1977, abandoned.

[51] Int. Cl.[2] ..... A63B 53/06

[52] U.S. Cl. ..... 273/79; 273/162 B; 273/183 D; 273/171

[58] Field of Search ..... 273/77 R, 79, 80 C, 273/164, 167–175, 162 B, 183 D, 193 R, 194 R, 194 A

[56] References Cited

U.S. PATENT DOCUMENTS

| | | | |
|---|---|---|---|
| 1,352,020 | 9/1920 | Olson | 273/79 |
| 2,201,638 | 5/1940 | Thiebault | 273/173 X |
| 2,222,534 | 11/1940 | Harris | 273/79 |
| 2,923,552 | 2/1960 | Sunberg | 273/162 B X |
| 3,429,576 | 2/1969 | Ikeda | 273/162 B |
| 3,459,426 | 8/1969 | Sherwood | 273/164 X |
| 3,652,094 | 3/1972 | Glover | 273/173 X |
| 3,758,115 | 9/1973 | Hogland | 273/80 C X |
| 4,067,572 | 1/1978 | Coleman | 273/79 |

*Primary Examiner*—Charles E. Phillips
*Attorney, Agent, or Firm*—Sughrue, Rothwell, Mion, Zinn and Macpeak

[57] ABSTRACT

The golf putter includes an elongated tapered body having a vertical plane of symmetry extending in the direction of putting motion and an adjustable putting face secured to the leading surface of the tapered body. The putting face is provided with a loft no greater than 10° and the face is pivotable about a horizontal axis on the plane of symmetry so that the face can be adjusted to a horizontal position for a particular angle of the putter shaft relative to the vertical and then secured to the body. The weight of the putter head is also adjustable.

6 Claims, 8 Drawing Figures

ADJUSTABLE GOLF PUTTER

RELATED APPLICATION

This application is a continuation-in-part of application Ser. No. 852,644, filed Nov. 18, 1977 now abandoned.

BACKGROUND OF THE INVENTION

1. Field of the Invention

The present invention is directed to a golf club and more specifically to a putter having an adjustable putter face and means for adjusting the weight of the putter head.

2. Prior Art

It is old and well known in the art to provide a golf club putter with an elongated body which extends in the direction of the putting motion. The body may be symmetrical relative to a vertical plane and an elongated indicator may be provided on the upper surface of the body to aid the golfer in lining up the direction of the putt. The patents to Warpotas, U.S. Pat. No. 2,957,969; Hoglund, U.S. Pat. No. 3,758,115; Zitko, U.S. Pat. No. 3,888,484; Carper, U.S. Pat. No. Des. 179,590; and Warner, U.S. Pat. No. Des. 228,003 are examples of such prior art patents.

The patent to Robertson, U.S. Pat. No. 823,083 shows a club face which is separate from the elongated tapered head and which is secured thereto by means of screws. The bottom edge of the putter face is rounded to accommodate any variation in the angle at which the shaft will be disposed during the putting stroke but the face of the putter is not adjustable relative to the body of the putter.

It is also old and well known in the art to have the entire putter head adjustably mounted on the end of the shaft as evidenced by the U.S. Pat. Nos. 1,352,020 to Olson and 2,222,534 to Harris. The patent to Coleman shows an adjustable golf club face on a hollow part spherical club head which may be partially filled with sand or liquid to adjust the weight of the club head. Finally the patent to Ikeda shows a putter having a level built into the putter head.

SUMMARY OF THE INVENTION

The golf putter according to the present invention provides a unique putter having an angled putter face which is adjustable relative to the body of the putter so that the loft of the face can be disposed horizontally for a particular angle of the putter shaft relative to the vertical.

The golf putter according to the present invention provides an elongated tapered body having a vertical plane of symmetry extending in the direction of the putting motion in combination with an adjustable putting face secured to the leading end of the tapered body.

The golf putter according to the present invention provides elongated indicator means on the upper surface of the elongated tapered body disposed in the plane of symmetry to aid the golfer in lining up the putt. The adjustable putting face secured to the elongated body is disposed for pivotal movement about a horizontal axis line in the plane of symmetry.

The golf putter according to the present invention is provided with elongated tapered body having a vertical plane of symmetry extending in the direction of the putting motion with the bottom surface of the body also being curved upwardly to accommodate follow-through. The lower edge of the adjustable putter face secured to the leading edge of the body is also curved in a direction perpendicular to the curvature on the bottom surface of the body to accommodate the adjustment of the face relative to the body.

The golf putter according to the present invention is provided with an elongated tapered body having a plane of symmetry extending in the direction of the putting motion and an adjustable putting face secured to the leading end of the tapered body. Level indicating means are provided on the adjustable face to assist in leveling the face for a given preferred putting stance and securing means are provided for temporarily holding the face in adjusted position relative to the body of the putter prior to permanent securement of the face to the body by any suitable means such as an epoxy adhesive or the like. The level indicating means may either be built into the putter face or detachably secured thereto so that the level indicating means may be removed once the face has been secured to the body in the desired position. Adjustable weight means are also provided within the body whereby the weight of the head can be adjusted prior to permanently securing the face to the body.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
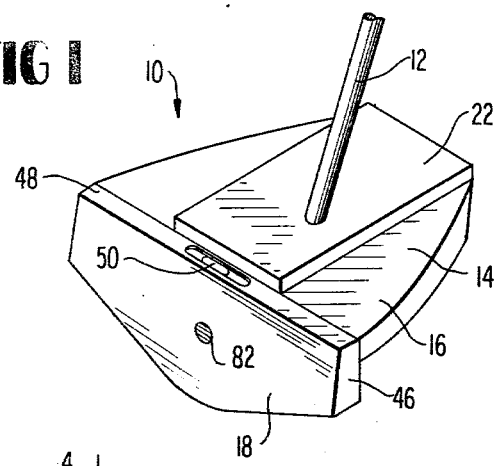
FIG. 1 is a perspective view of the putter head and the lower portion of the shaft according to the present invention showing one form of level arrangement.
Figure 3:
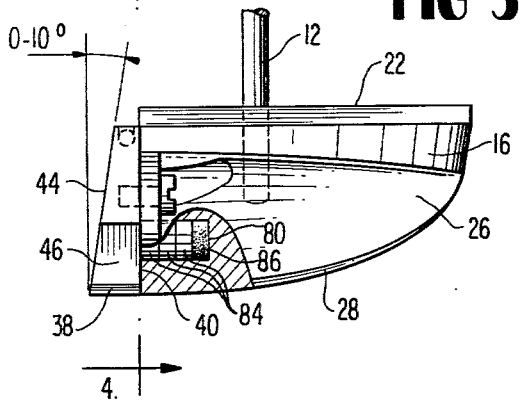
FIG. 3 is a side elevational view of the putter head and face according to the present invention with a portion broken away to show the adjustable weight means.
Figure 4:
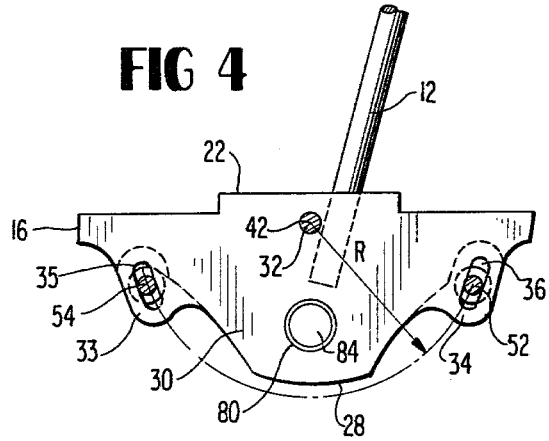
FIG. 4 is a sectional view taken along the line 4—4 of FIG. 3.
Figure 6:
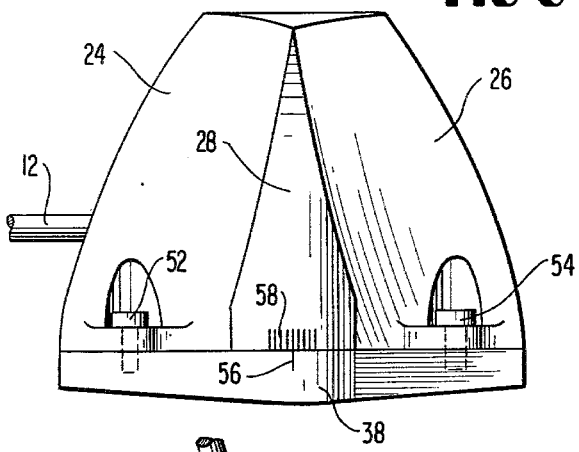
FIG. 6 is a bottom plan view of the putter head according to the present invention.
Figure 5:
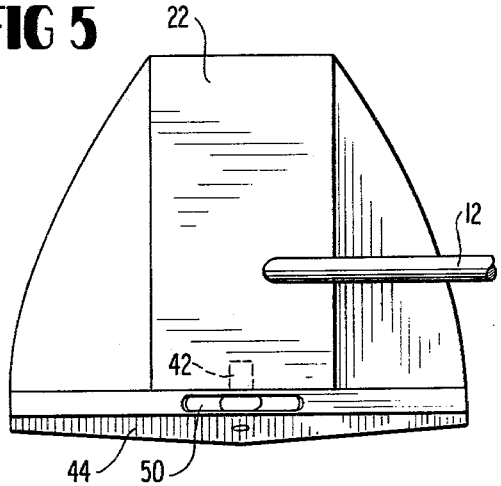
FIG. 5 is a top plan view of the putter head as shown in FIG. 1.
Figure 7:
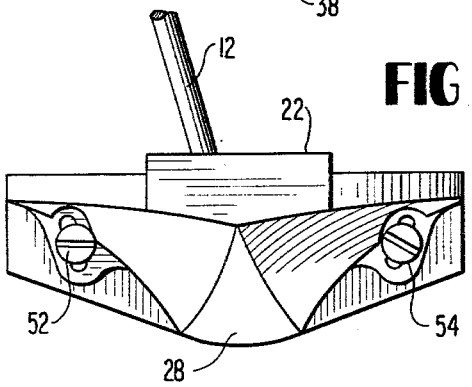
FIG. 7 is a rear elevational view of the putter head according to the present invention.

The golf putter 10 as shown in FIG. 1 is comprised of a conventional shaft 12 and the new and improved putter head 14 which includes a body 16 and a separate putter face 18 which is initially adjustable relative to the body prior to permanent securement. The body 16 has an elongated tapered construction which is symmetrical about the vertical plane 20 which extends in the direction of the putting motion. The upper surface of the body 16 is provided with an elongated raised surface 22 which extends in the direction of putting motion to assist the golfer in lining up the direction of the putt. The underside of the body 16 is cut-away and tapered rearwardly on opposite sides of the plane of symmetry 20 to provide identical side faces 24 and 26. The bottom surface 28 of the body 16 is provided with a rearwardly and upwardly extending curvature as best seen in FIG. 3 so that the rear of the putter head will not drag on the ground during follow-through. The bottom surface 28 is also provided with a curvature in the transverse direction as best seen in FIG. 4 so that the putter head can be tilted about a horizontal axis extending in the direction of putting. The front face 30 of the head 16 is flat and disposed in a plane parallel to the shaft 12. The bore 32 is provided in the upper center of the face 30 and a pair of depending ears 33 and 34 are symmetrically provided at each side of the face 30 having arcuate slots 35 and 36 therein, respectively. The center of curvature for each slot 35 and 36 is the center of the bore 32 and the radii of the two slots are equal.

The putter face 18 has a generally wedge shaped configuration as best seen in FIG. 3 and the bottom surface 38 of the face is provided with curvature identical to the curvature of the bottom 28 of the head 16. Face 40 of the putter face 18 is flat and adapted to be rotatably mounted on the front face 30 of the head 16 by means of a rearwardly extending pin 42 secured to the upper center of the face 40 and rotatably mounted in the bore 32 in the face 30. The front face 44 of the putter face 18 is disposed at an angle relative to the rear face 40 so as to provide a loft of no more than 10°. The end surfaces 46 of the putter face 18 are squared off perpendicular to the top surface 48 of the putter face 18 which has a bubble level 50 recessed therein. A pair of screws 52 and 54 extend freely through the slots 35 and 36 and are threaded into apertures in the rear surface 40 of the putter face 18 to secure the putter face 18 against rotation relative to the putter head 16 about the pin 42. A single indicia 56 is provided in the center of the bottom surface 38 of the putter face 18 and a plurality of indicia 58 are provided on the lower surface 28 of the putter head 16.

Figure 8:
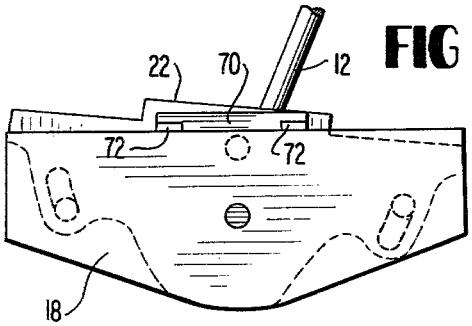
FIG. 8 is a front elevational view similar to FIG. 2 with the putter face adjusted so that the upper surface thereof is disposed at an angle to the upper surface of the putter head and showing a second modified level arrangement.

Since the putting stances of golfers vary so widely, it is ordinarily difficult to provide the putter with any degree of loft on the putting face since the face would then be horizontally disposed for only one specific angle of inclination of the putter shaft relative to the vertical. Obviously, golfers would not necessarily hold the shaft at this predetermined angle which would allow the face of the putter to be disposed horizontally. However, the putting face 18 of the present invention can be adjusted relative to the putting head 16 for any given putting stance so that the putting face will be disposed horizontally. In order to accomplish this a golfer would assume his usual putting stance. In this particular stance the shaft 12 will be disposed at a given angle relative to the vertical and the upper surface 48 of the putter face 18 might or might not be disposed horizontally. The bubble level 50 will indicate to the golfer whether or not the putter face is level for this preferred stance. If the putter face is not level, the golfer merely has to losen the screws 52 and 54 and pivot the putter face 18 about the pin 42 to adjust the angle between the upper surface 48 of the putter face and the shaft 12. When the bubble level 50 registers level for the preferred putting stance of the golfer, the single indicia 56 on the putter face 18 will be disposed at a specific position relative to the multiple indicia 58 on the bottom of the putter head. Since the rules of the professional golf association do not permit the use of adjustable clubs, it is then necessary for the golfer to permanently secure the putter face in this preferred position of the putter face relative to the putter head. One method of accomplishing this would be to weld the screw heads 52 and 54 to the putter head 16 after the putter face 18 has been adjusted to the desired position relative to the putter head 16 and the screws have been tightened down. Another possible method of permanent securement would be to remove the putter face after the previously described adjustment procedure is completed, coat the surfaces 30 and 40 with an epoxy adhesive and premanently secure the putter face to the putter body with the indicia 56 and 58 aligned in the previously determined desirable position. In the adjusted position the putter head 18 might be disposed relative to the putting face as shown in FIG. 8. Thus, in the adjusted position, the curvature of the bottom surfaces 38 and 28 will be coincident and the slight inclination of the raised surface 22 will not effect the golfer's ability to use this raised surface as a means for aligning the direction of the putt. Therefore, assuming the golfer takes the same putting stance consistently after adjusting the putting face to be level for that particular stance, the golfer will always be assured of having a horizontal putting face so that the loft of the putting face will not have any detrimental effect on the direction of the putt.

The details of the putter construction may be widely varied without affecting the scope of the present invention. The upper surface of the putter head 16 could have any other desirably elongated indicia in lieu of or in addition to the raised surface 22. The rearwardly tapered configuration of the putting head and the gullwing configuration on the undersurface thereof have been adopted to reduce the overall weight of the club while concentrating the weight of the club directly behind the sweetspot. Thus, the overall width of the putting face 44 can be reduced and thereby lessen the possibility of the turning torque being applied to the putter head due to contact with the ball at a point too far removed from the sweetspot.

In all instances, it is necessary to comply with the U.S. Golf Association rules concerning club construction. Since the angle of the shaft relative to a verticle line extending perpendicular to the horizontal line determining the length of the club head must be at least 10°, the length of the slots 35 and 36 should be designed so that the top edge of the face cannot be adjusted to a position which would render such angle less than 10°.

Figure 2:
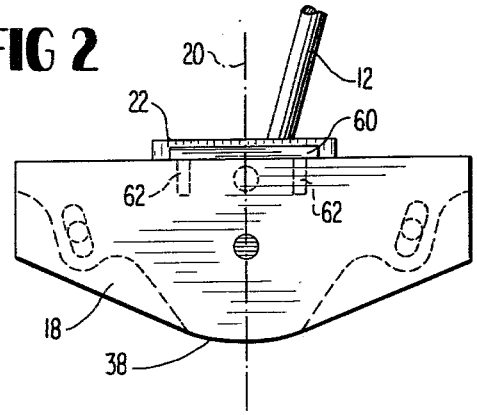
FIG. 2 is a front view of the putter face showing a first modified level arrangement.

Also if the provision of a level on the putter face member is not within the rules, the level could be detachably mounted on the putter face member for removal after the necessary adjustment is accomplished. The level 60 as shown in FIG. 2 is provided with two spaced apart pins 62 which are secured in complimentary sockets drilled in the top of the putter face member. The level 70 as shown in FIG. 8 is provided with one or more magnets 72 which hold the level in place on the upper surface of the steel face member.

It would also be possible to substitute a putter face member which does not have a level thereon for the one with the level after the relative position of the indicia lines are determined. It would then be a simple matter to merely place the indicia lines on the putter head and the putter face member without the level in the same relative positions before securing the putter face member without the level to the putter head by any means within the rules.

An adjustable weight arrangement is provided for the putter head as best seen in FIGS. 3 and 4. A bore 80 is disposed in the putter head 16 perpendicular to the face 30 and in substantial alignment with the sweetspot 82. Three cylindrical weight inserts 84 of lead or the like and one lightweight cylindrical plastic insert 86 are located in the bore 80 and completely fill the length of the bore. Sufficient clearance should be provided between the cylindrical inserts 84, 86 and the wall of the bore 80 to allow free insertion and removal without undue loosening. The inserts 84 and 86 are preferably identical in size so that the number of plastic inserts and the number of heavier inserts are readily interchangable to vary the total weight. When the face member is permanently secured to the putter head the desired combination of weights will be fixed within the putter head.

While the invention has been particularly shown and described with reference to a preferred embodiment thereof, it will be understood by those skilled in the art that the foregoing and other changes in the form and details may be made therein without departing from the spirit and scope of the invention.

What is claimed is:

1. A golf putter comprising a head having a flat elongated front face and rearwardly tapering sides and bottom surfaces, a shaft secured to said head at an angle greater than 90° relative to the length of said elongated face on said head and disposed parallel to the plane of said face on said head, a putter face member rotatably mounted on said head for rotating about an axis perpendicular to said face of said head and means for securing said putter face to said head in a plurality of positions relative to said head, said putter face member being provided with a flat rear face engageable with the flat front face of said head and a front ball engaging face inclined relative to the rear face of the face member, said putter head being provided with a vertical plane of symmetry in a putting direction with a bore located in a flat front surface on said line of symmetry and said face member being provided with a pin on the rear surface thereof extending into said bore for rotatably mounting said face member on said head, at least one curved slot extending through the front face of said head with said bore as the center of curvature for said slot and screw means extending through said slot into threaded engagement with a bore in the rear face of said face member for securing said face member in adjusted angular position relative to said head, and level indicating means located on the upper surface of said face member and extending parallel to the line of intersection of the planes of the front and rear faces of the face member.

2. A golf putter as set forth in claim 1, wherein the bottom surface of said head and the bottom surface of said face member are provided with identical curvatures in the plane of engagement between the head and face member.

3. A golf putter as set forth in claim 1, wherein said level indicating means is permanently secured in said face member.

4. A golf putter as set forth in claim 1, wherein said level indicating means is detachably secured to the upper surface of said face member.

5. A golf putter as set forth in claim 1, wherein adjustable weight means are disposed in said putter head.

6. A golf putter as set forth in claim 5, wherein said putter head is provided with a cylindrical bore extending into the head perpendicular to said flat elongated face and said weight means are comprised of a plurality of cylindrical weight means removably disposed in said bore to vary the weight of the putter.

* * * * *